US005734313A

United States Patent [19]

Doi et al.

[11] Patent Number: 5,734,313

[45] Date of Patent: Mar. 31, 1998

[54] CHIP-TYPE COMPOSITE ELECTRONIC COMPONENT

[75] Inventors: Masato Doi, Kyoto; Hirotoshi Inoue; Seiji Mitsuno, both of Yukuhashi, all of Japan

[73] Assignee: Rohm Co., Ltd., Kyoto, Japan

[21] Appl. No.: 669,399

[22] PCT Filed: Jan. 4, 1996

[86] PCT No.: PCT/JP96/00002

§ 371 Date: Jun. 27, 1996

§ 102(e) Date: Jun. 27, 1996

[87] PCT Pub. No.: WO96/21233

PCT Pub. Date: Jul. 11, 1996

[30] Foreign Application Priority Data

Jan. 6, 1995 [JP] Japan ..... 7-000730

[51] Int. Cl.[6] ..... H01C 1/02; H01C 1/14

[52] U.S. Cl. ..... 338/260; 338/325; 338/327; 338/328; 338/329; 338/319; 338/320

[58] Field of Search ..... 328/321–333, 328/309, 260, 319, 320

[56] References Cited

U.S. PATENT DOCUMENTS 4,829,553 5/1989 Shindo et al. .

5,285,184 2/1994 Hatta et al. .

FOREIGN PATENT DOCUMENTS 3-053097 3/1991 Japan .

5-335117 12/1993 Japan .

6-053016 2/1994 Japan .

*Primary Examiner*—Peter S. Wong

*Assistant Examiner*—K. Shin

*Attorney, Agent, or Firm*—Merchant Gould Smith Edell Welter & Schmidt

[57] ABSTRACT

A chip-type composite electronic component according to the present invention comprises an insulating substrate (1), a common electrode (2) formed on the substrate (1), a plurality of individual electrodes (**3*a*–3*h*) formed on the substrate (1) to be spaced from the common electrode (2), and a plurality of electronic elements (4*a*–4*e*) each interposed between each of the individual electrodes (3*a*–3*h*) and the common electrode (2). Each of the common electrode (2) and individual electrodes (3*a*–3*h*) has a plated solder layer as an outermost layer. Each of the electronic elements (4*a*–4*e*) has a direct current resistance of no less than 47K Ω, and the solder layer of the common electrode (2) has a layer thickness which is no more than 2.9 times as great as that of the solder layer of the individual electrodes (3*a*–3*h***).

7 Claims, 6 Drawing Sheets

| | Resistance | Layer Thickness Ratio: With Agitators | Layer Thickness Ratio: No Agitators |
|---|---|---|---|
| Solder Layers | 10KΩ | 2.33 | 2.20 |
| | 47KΩ | 2.37 | 3.04 |
| | 100KΩ | 2.68 | 5.02 |
| Nickel Layers | 10KΩ | 2.35 | 2.78 |
| | 47KΩ | 3.20 | 3.44 |
| | 100KΩ | 2.93 | 4.29 |

Fig. 7

| | | Layer Thickness Ratio | |
|---|---|---|---|
| | Resistance | With Agitators | No Agitators |
| Solder Layers | 10KΩ | 2.33 | 2.20 |
| | 47KΩ | 2.37 | 3.04 |
| | 100KΩ | 2.68 | 5.02 |
| Nickel Layers | 10KΩ | 2.35 | 2.78 |
| | 47KΩ | 3.20 | 3.44 |
| | 100KΩ | 2.93 | 4.29 |

CHIP-TYPE COMPOSITE ELECTRONIC COMPONENT

TECHNICAL FIELD

The present invention relates to a chip-type composite electronic component which comprises a common electrode, a plurality of individual electrode, and a plurality of electronic elements each interposed between each of the individual electrodes and the common electrode.

BACKGROUND ART

Examples of chip-type composite electronic components include a composite resistor incorporating a plurality of resistor elements, a composite capacitor incorporating a plurality of capacitor elements, and a composite diode incorporating a plurality of diode elements.

Of these, a typical composite resistor comprises a single substrate, a common electrode formed on the substrate, a plurality of individual electrodes formed on the substrate to be spaced from the common electrode, and a plurality of resistor elements (film-like resistor elements) each interposed between each of the individual electrodes and the common electrode. Each of the common electrode and individual electrodes includes a thick film layer of silver-palladium alloy, a nickel layer plated on the thick film layer, and a solder layer plated on the nickel layer.

With the prior art chip-type composite resistor having the above-described structure, the thickness of the nickel and solder layers of the common electrode increases at an extremely higher rate than the thickness of the nickel and solder layers of each, individual electrode as the resistance of the film-like resistor elements increases. This can be understood by referring to the "no agitator" column in the table shown in FIG. 7.

Specifically, the "no agitator" column in the FIG. 7 table shows, with respect to a multiplicity of prior art chip-type composite resistors for each of different resistance values of resistor elements, a ratio between the thickness (average) of the solder layers of the common electrodes and the thickness (average) of the solder layers of the individual electrodes. The table also shows a ratio between the thickness (average) of the nickel layers of the common electrodes and the thickness (average) of the nickel layers of the individual electrodes. According to the table, when the resistance of the resistor elements is 10K Ω, the thickness of the solder layer of the common electrode is 2.20 times as great as the thickness of the solder layer of the individual electrodes, whereas the thickness of the nickel layer of the common electrode is 2.78 times as great as the thickness of the nickel layer of the individual electrodes. When the resistance of the resistor elements is 47K Ω, the thickness of the solder layer of the common electrode is 3.04 times as great as the thickness of the solder layer of the individual electrodes, whereas the thickness of the nickel layer of the common electrode is 3.44 times as great as the thickness of the nickel layer of the individual electrodes. Further, when the resistance of the resistor elements is 100K Ω, the thickness of the solder layer of the common electrode is 5.02 times as great as the thickness of the solder layer of the individual electrodes, whereas the thickness of the nickel layer of the common electrode is 4.29 times as great as the thickness of the nickel layer of the individual electrodes.

The above results are considered mainly attributable to the combination of the following two causes. First, in the process of plating nickel and solder layers, a multiplicity of chip-type composite resistors which are simultaneously plated will suffer great variations, from resistor to resistor, in the rate or speed of forming the nickel and solder layers. Thus, if the respective thickness of nickel and solder layers is adjusted to have a predetermined value with respect to composite resistors undergoing slower layer formation, the nickel and solder layers of other composite resistors undergoing faster layer formation will grow to have an excessively large thickness. Secondly, since the individual electrodes connected to the resistor elements having a large electrical resistance will suffer difficulty in forming nickel and solder layers, the nickel and solder layers of the common electrode having an extremely low resistance will tend to have an excessively large thickness if the respective thickness of nickel and solder layers of the individual electrode is made to have a predetermined value.

With the prior art chip-type composite resistor, if the direct current resistance of the resistor elements is large, the solder layer of the common electrode becomes extremely large. When soldering the common electrode onto a land portion of a board by using solder paste for example, hydrogen gas remains inside the solder as foams which cause the solder surfaces to be greatly roughened. Specifically, at the time of soldering, the solder layer of the common electrode melts to generate hydrogen gas which is occluded in the solder layer. If the solder layer has a small thickness, the generated hydrogen gas will escape to the exterior without remaining inside the solder while the solder is still in a molten state. However, if the thickness of the solder layer is large, a portion of the hydrogen gas generated at a deep position of the solder layer cannot go out before solidification of the solder, consequently remaining as foams within the solder.

In this way, the solder surfaces at the common electrode are greatly roughened due to the remaining hydrogen gas foams. Such surface roughening can be a cause for an erroneous detection when automatically detecting the presence, position or posture of the chip-type composite electronic component by light reflection at the solder surface for example.

Further, with the prior art composite electronic component, since the thickness of the nickel layer 14*a* becomes extremely large if the direct current resistance is large, the nickel layer is deformed under thermal stresses caused by temperature fluctuations after soldering, thereby lifting up and breaking the thick film layer.

DISCLOSURE OF THE INVENTION

The present invention is proposed in view of the above-described problems of the prior art and aims to provide a chip-type composite electronic component wherein solder surfaces at a common electrode are not largely roughened after soldering.

Another object of the present invention is to provide a chip-type composite electronic component wherein thick film layers are prevented from breaking due to thermal deformation of nickel layers.

According to a first aspect of the present invention, there is provided a chip-type composite electronic component comprising: an insulating substrate; a common electrode formed on the substrate; a plurality of individual electrodes formed on the substrate to be spaced from the common electrode, and a plurality of electronic elements each interposed between each of the individual electrodes and the common electrode; wherein each of the common electrode and individual electrodes has a plated solder layer as an outermost layer; characterized that each of the electronic elements has a direct current resistance of no less than 47K Ω, the solder layer of the common electrode having a layer thickness which is no more than 2.9 times as great as that of the solder layer of the individual electrodes.

With the arrangement described above, though the direct current resistance of each electronic element is relatively large, the thickness of the solder layer of the common electrode is limited only to no more than 2.9 times as great as the thickness of the solder layer of each individual electrode. Thus, even if the thickness of the solder layer of the individual electrode is made to have a predetermined value, the solder layer of the common electrode will not have an excessively large thickness. As a result, when the chip-type composite electronic component is mounted on a separate board for soldering the common electrode thereof a land portion of the board by using a solder paste for example, hydrogen gas will not remain in the solder as foams, thereby preventing the solder surfaces from being greatly roughened.

More specifically, at the time of soldering, the solder layer of the common layer melts with the solder paste to generate hydrogen gas occluded in the solder layer. However, since the thickness of the the solder layer is small, hydrogen gas escapes to the exterior without remaining inside the solder while the solder is still in molten state. In this way, hydrogen gas does not remain inside the solder as foams, so that the solder surfaces at the common electrode is prevented from being largely roughened. As a result, it is possible to prevent an erroneous detection when automatically detecting the presence, position or posture of the chip-type composite electronic component by light reflection at the solder surfaces for example.

According to a second aspect of the present invention, there is provided a chip-type composite electronic component comprising: an insulating substrate; a common electrode formed on the substrate; a plurality of individual electrodes formed on the substrate to be spaced from the common electrode, and a plurality of electronic elements each interposed between each of the individual electrodes and the common electrode; wherein each of the common electrode and individual electrodes has a plated nickel layer; characterized that each of the electronic elements has a direct current resistance of no less than 47K Ω, the nickel layer of the common electrode having a layer thickness which is no more than 3.2 times as great as that of the nickel layer of the individual electrodes.

With the arrangement described above, though the direct current resistance of each electronic element is relatively large, the thickness of the nickel layer of the common electrode is limited only to no more than 3.2 times as great as the thickness of the nickel layer of each individual electrode. Thus, even if the thickness of the nickel layer of the individual electrode is made to have a predetermined value, the nickel layer of the common electrode will not have an excessively large thickness. Therefore, the underlying thick film layer can be prevented from being lifted to break due to thermal stresses imparted to the nickel layer by temperature fluctuations after soldering.

According to a preferred embodiment of the present invention, the electronic elements are resistors which are equal to each other in resistance.

However, each of the electronic elements may be a capacitor which has a direct current resistance of no less than 47K Ω when sufficiently charged. In this case, though a capacitor exhibits a direct current resistance of nearly zero in the absence of any charge, its direct current resistance increases substantially to infinity when completely charged. Therefore, a capacitor is deemed to provide a large direct current resistance at the time of plating solder layers, thus falling within the scope of the present invention.

Alternatively, each of the electronic elements may be a diode which has a reverse direct current resistance of no less than 47K Ω. In the case of a diode, though it exhibits a forward direct current resistance of nearly zero, its reverse direct current resistance is substantially infinite. Therefore, a diode is deemed to provide a large direct current resistance at the time of plating solder layers, thus falling in the scope of the present invention. An example of diode is a leadless diode.

BRIEF DESCRIPTION OF THE DRAWINGS

FIG. 7 is a table showing the ratio in solder layer thickness between the common terminal and the individual electrode with respect to chip-type composite electronic components in comparison with prior art chip-type composite electronic components.

BEST MODE FOR CARRYING OUT THE INVENTION

A preferred embodiment of the present invention is now described below with reference to the accompanying drawings.

Figure 1:
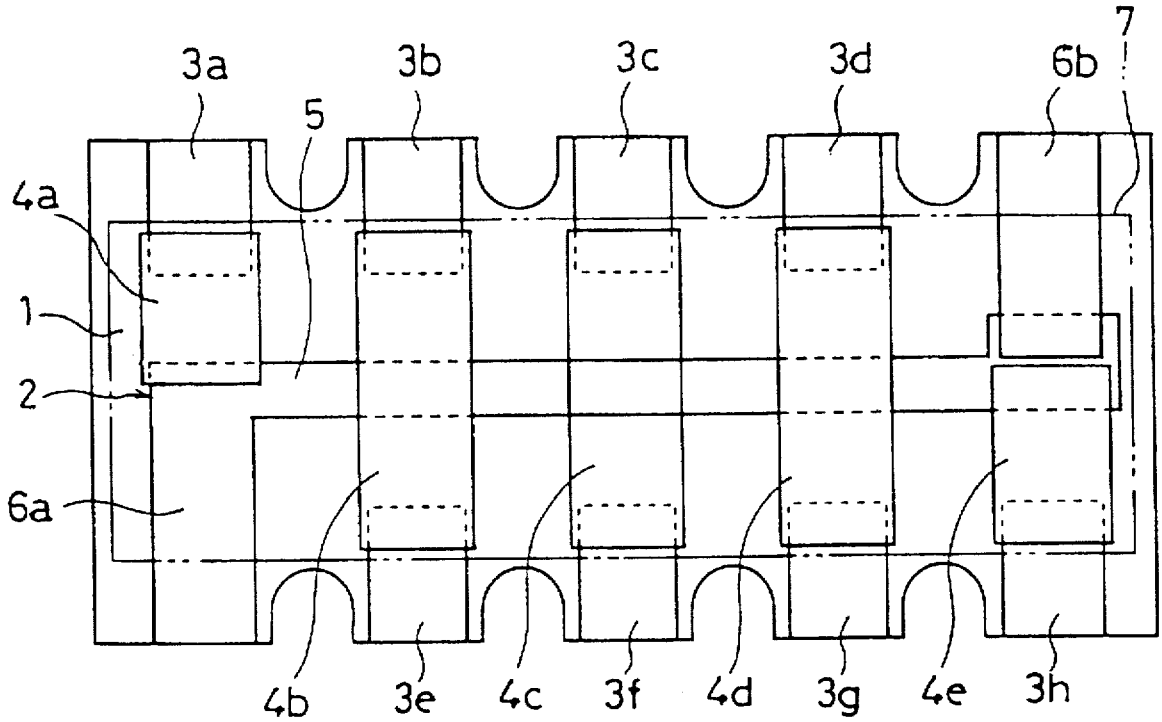
FIG. 1 is a plan view showing a chip-type composite electronic component according to the present invention.

Referring to FIG. 1, a substrate 1 has an obverse surface formed with a common electrode 2, a plurality of individual electrodes *3a–3h*, and a plurality of film-like resistor elements *4a–4e*. The substrate 1 may be made of an insulating material such as ceramic and has a generally rectangular shape. However, the shape of the substrate 1 is not limitative.

The common electrode 2 includes a main strip portion 5 and common terminals *6a*, *6b* at both ends of the main strip portion 5. The main strip portion 5 of the common electrode 2 is located at the widthwise center of the substrate 1 and extends longitudinally of the substrate 1 to both ends thereof. One common terminal *6a* (hereafter referred to as "first common terminal") of the common electrode 2 overlaps the main strip portion 5 and extends beyond one longitudinal edge (hereafter referred to as "first longitudinal edge") of the substrate 1 onto the reverse surface thereof (see FIG. 4A). The other common terminal *6b* (hereafter referred to as "second common terminal") of the common electrode 2 is formed integrally with the main strip portion 5 and extends beyond the other longitudinal edge (hereafter referred to as "second longitudinal edge") of the substrate 1 onto the reverse surface thereof (though not shown but similar to the first common terminal 6a shown in FIG. 4A).

The plurality of individual electrodes 3a–3h are divided into a first group of individual electrodes 3a–3d arranged adjacent to the first longitudinal edge of the substrate 1, and a second group of individual electrodes 3e–3h arranged adjacent to the second longitudinal edge of the substrate 1. The individual electrodes 3a–3d of the first group, which are constantly spaced from each other longitudinally of the substrate 1 and disposed in parallel to the first common terminal 6a, extend beyond the first longitudinal edge of the substrate 1 onto the reverse surface thereof (though not shown but similar to the first common terminal 6a shown in FIG. 4A). Likewise, the individual electrodes 3e–3h of the second group, which are constantly spaced from each other longitudinally of the substrate 1 and disposed in parallel to the second common terminal 6b, extend beyond the second longitudinal edge of the substrate 1 onto the reverse surface thereof (though not shown but similar to the first common terminal 6a shown in FIG. 4A).

The individual electrode 3a of the first group is aligned with the second common terminal 6b of the common electrode 2 transversely of the substrate 1. Similarly, the individual electrode 3h of the second group is aligned with the first common terminal 6a of the common electrode 2. Further, the individual electrodes 3b–3d of the first group are aligned respectively with the individual electrodes 3e–3g of the second group.

The film-like resistor element 4a is formed to overlap the main strip portion 5 of the common electrode 2 and the individual electrode 3a of the first group. Similarly, the film-like resistor element 4e is formed to overlap the main strip portion 5 of the common electrode 2 and the individual electrode 3h of the second group. Further, the resistor elements 4b, 4c, 4d are formed to respectively overlap the individual electrodes 3b, 3c, 3d of the first group as well as the individual electrodes 3e, 3f, 3g of the second group while centrally overlapping the main strip portion 5 of the common electrode 2.

Figure 2:
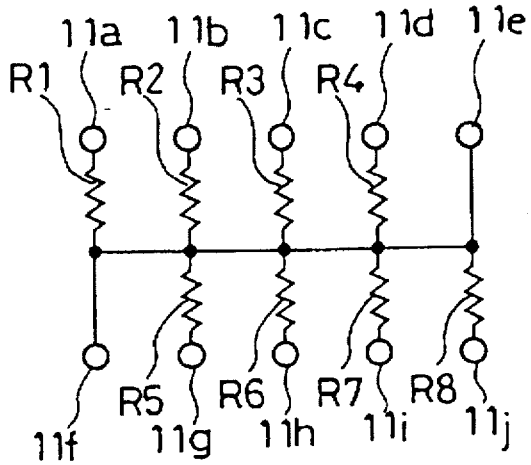
FIG. 2 is a circuit diagram equivalent to the same composite electronic component.

FIG. 2 shows an equivalent circuit of the above-described chip-type composite electronic component. The equivalent circuit comprises a plurality of resistors R1–R8 and a plurality of terminals 11a–11j. The resistors R1–R4 are connected respectively to the terminals 11a–11d at one end, whereas the resistors R5–R8 are connected respectively to the terminals 11g–11j at one end. The resistors R1–R8 are connected respectively to the terminals 11e, 11f at the other end. The terminals 11a–11d are provided respectively by the individual electrodes 3a–3d of the first group, whereas the terminals 11e–11h are provided respectively by the individual electrodes 3e–3h of the second group. Further, the terminal 11e is constituted by the first common terminal 6a of the common electrode 2, whereas the terminal 11f is constituted by the second common terminal 6b. Moreover, the resistors R1, R8 are provided respectively by the resistor elements 4a, 4e, whereas the resistors R2–R7 are provided respectively by the resistor elements 4b–4d which are divided by the main strip portion 5 of the common electrode 2. In the illustrated embodiment, each of the resistors R1–R8 has a resistance of 100K Ω.

Figure 3A:
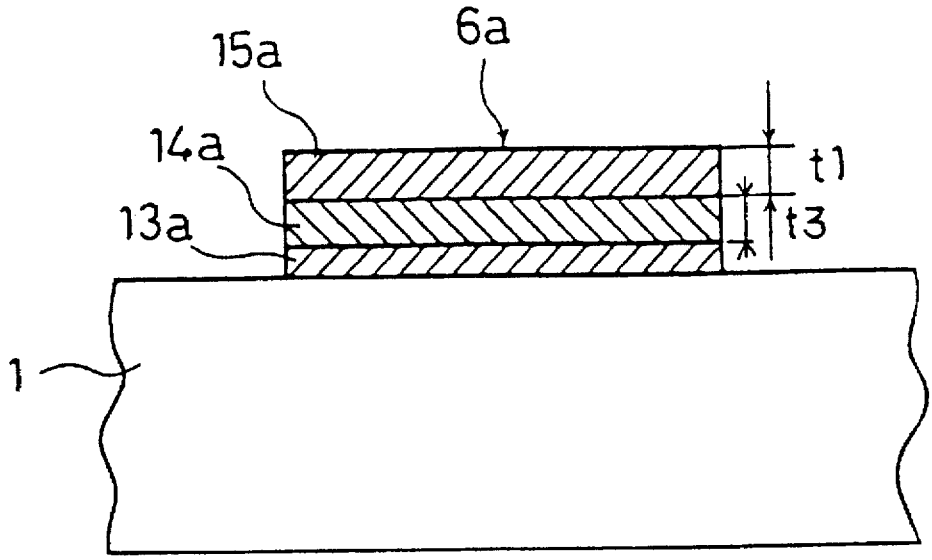
FIG. 3A is a sectional view taken at a common terminal portion of the same composite electronic component.

As shown in FIG. 3A, the first common terminal 6a of the common electrode 2 comprises a thick film layer 13a made of silver-palladium alloy, a nickel layer 14a plated on the thick film layer 13a, and a solder layer 15a (tin-lead alloy) plated on the nickel layer 14a. Such a structure also applies to the second common terminal 6b. However, the main strip portion of the common electrode 2 comprises only a thick film layer made of silver-palladium alloy (like the thick film layer 13a shown in FIG. 3A).

Figure 3B:
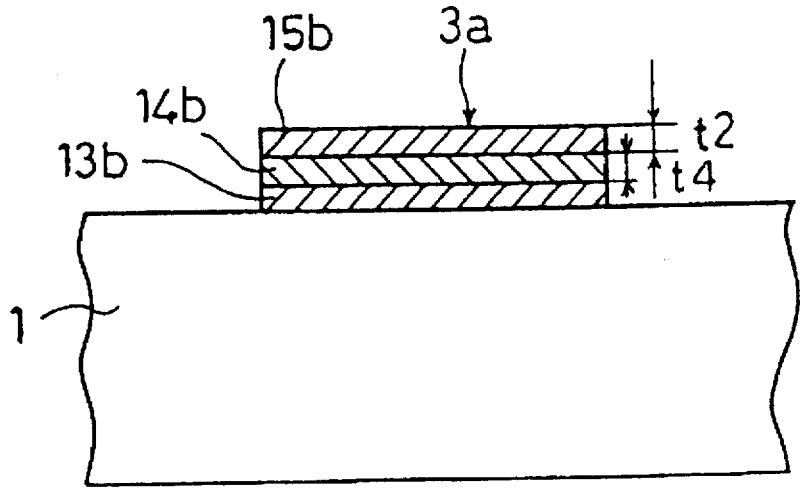
FIG. 3B is a sectional view taken at an individual electrode of the same composite electronic component.

Further, as shown in FIG. 3B, the individual electrode 3a also comprises a thick film layer 13b made of silver-palladium alloy, a nickel layer 14b plated on the thick film layer 13a, and a solder layer 15b (tin-lead alloy) plated on the nickel layer 14a. Such a structure also applies to the other individual electrodes 3b–3h.

In the illustrated embodiment, the thickness t1 of the solder layer 15a of the respective common terminals 6a, 6b is 2.68 times as great as the thickness t2 of the solder layer 15b of the respective individual electrodes 3a–3h. Further, the thickness t3 of the nickel layer 14a of the respective common terminals 6a, 6b is 2.93 times as great as the thickness t4 of the nickel layer 14b of the respective individual electrodes 3a–3h.

As indicated by the phantom lines in FIG. 1, the individual electrodes 3a–3h and the respective common terminals 6a, 6b together with the main strip portion 5 of the common electrode 2 are covered by a coating layer 7 made of an insulating material. Thus, like the main strip portion 5 of the common electrode 2, the portions of the individual electrodes 3a–3h and respective common terminals 6a, 6b covered by the coating layer 7 consist only of the thick film layer 13a or 13b and are not plated with nickel nor solder. FIGS. 3A and 3B are sections taken at a position of the first common electrode 6a and individual electrode 3a not covered by the coating layer 7.

As described above, the thickness t1 of the solder layer 15a of the respective common terminals 6a, 6b, which is 2.68 times as great as the thickness t2 of the solder layer 15b of the respective individual electrodes 3a–3h, is relatively small, corresponding roughly to a half of the solder layer thickness encountered in a prior art chip-type composite. Thus, when soldering the chip-type composite electronic component onto a separate board, the solder surfaces at the respective common terminal 6a, 6b are prevented from being greatly roughened due to foam formation.

Figure 4A:
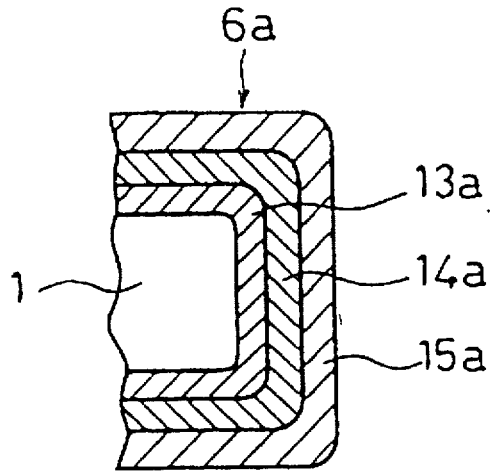
FIGS. 4A and 4B are sectional views taken at the common terminal portion of the same composite electronic component before and after soldering, respectively.
Figure 4B:
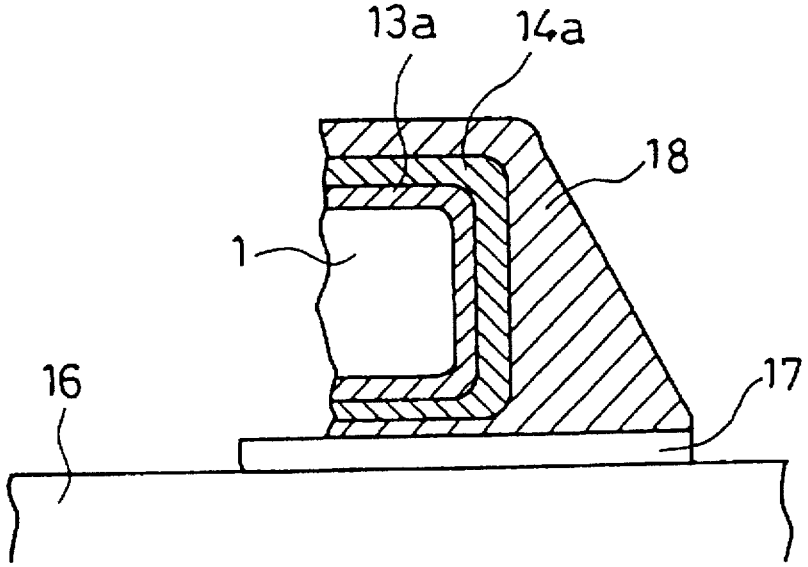

More specifically, as shown in FIGS. 4A and 4B, if the first common terminal 6a for example is placed on a land portion 17 of a separate board 16 and soldered thereto by using solder paste 18 for example, the solder layer 15a of the first common terminal 6a melts to merge with the solder paste 18. At this time, hydrogen occluded in the solder layer 15a is generated as hydrogen gas. The thus generated hydrogen gas tends to escape to the exterior while the solder paste 18 is still in its molten state. However, if the thickness of the solder layer 15a is large, a portion of the hydrogen gas generated at a deep position of the solder layer 15a cannot go out before solidification of the solder paste 18, consequently remaining as foams within the solder paste 18. Due to such foams, the surfaces of the solder paste 18, i.e., the solder surfaces at the common terminal 6a, are greatly roughened, as experienced in a prior art chip-type composite electronic component.

According to the illustrated embodiment, by contrast, the thickness of the solder layer 15a is smaller than conventionally possible, the generated hydrogen gas can sufficiently escape out before solidification of the solder paste 18. Thus, the surfaces of the solder paste 18, i.e., the solder surfaces at the common terminal 6a, are prevented from being greatly roughened due to foam formation.

In this way, surface roughening at the common terminal can be avoided. Thus, it is possible to prevent an erroneous detection when automatically detecting the presence, position or posture of the chip-type composite electronic component by surface light reflection at the solder paste 18 (common terminal 6a) for example. Further, the thickness t3 of the nickel layer 14a, which is 2.93 times as great as the thickness t4 of the nickel layer 14b, is also relatively small (corresponding roughly to ¾ of the nickel layer thickness encountered in a prior art chip-type composite electronic component, so that the thick film layer 13a can be prevented from being lifted to break due to thermal stresses imparted to the nickel layer 14a by temperature fluctuations after soldering.

Figure 5:
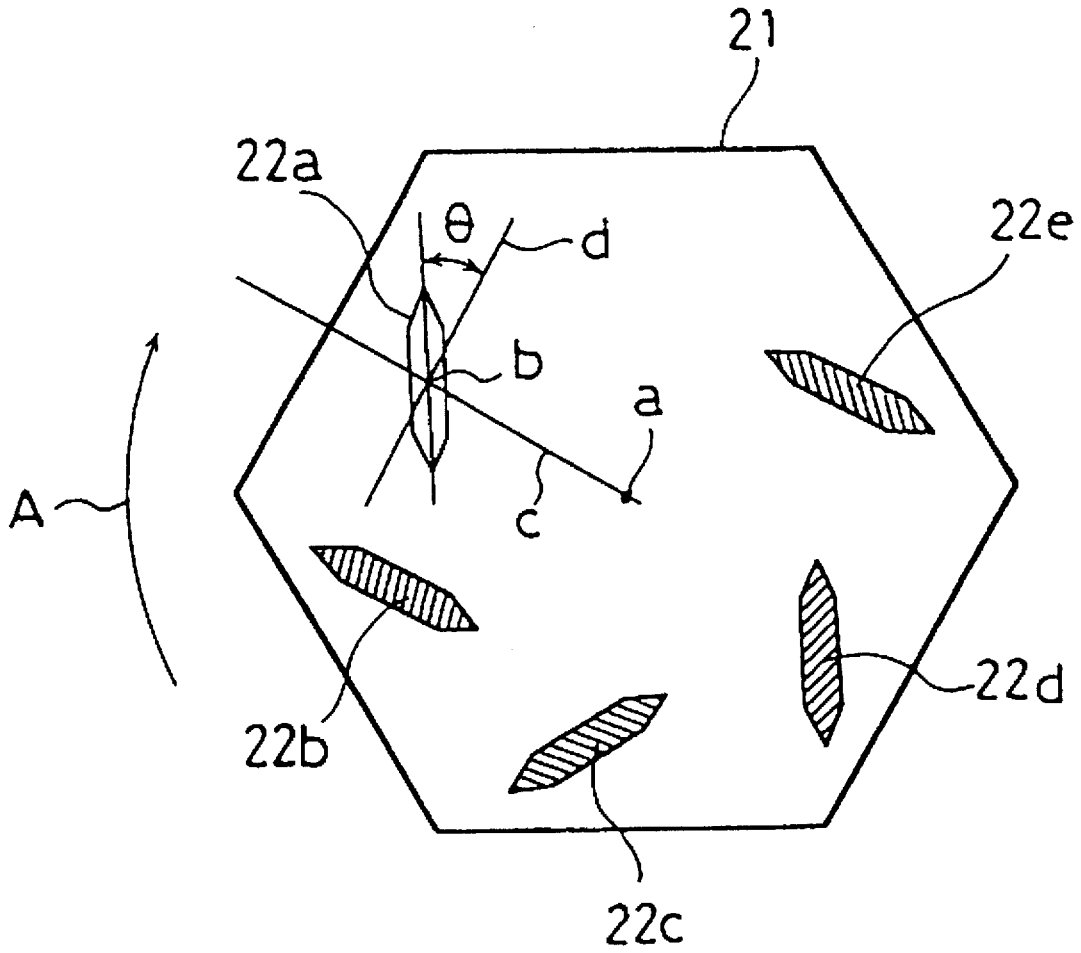
FIG. 5 is a schematic sectional view showing a plating barrel apparatus used for producing chip-type composite electronic components according to the present invention.
Figure 6:
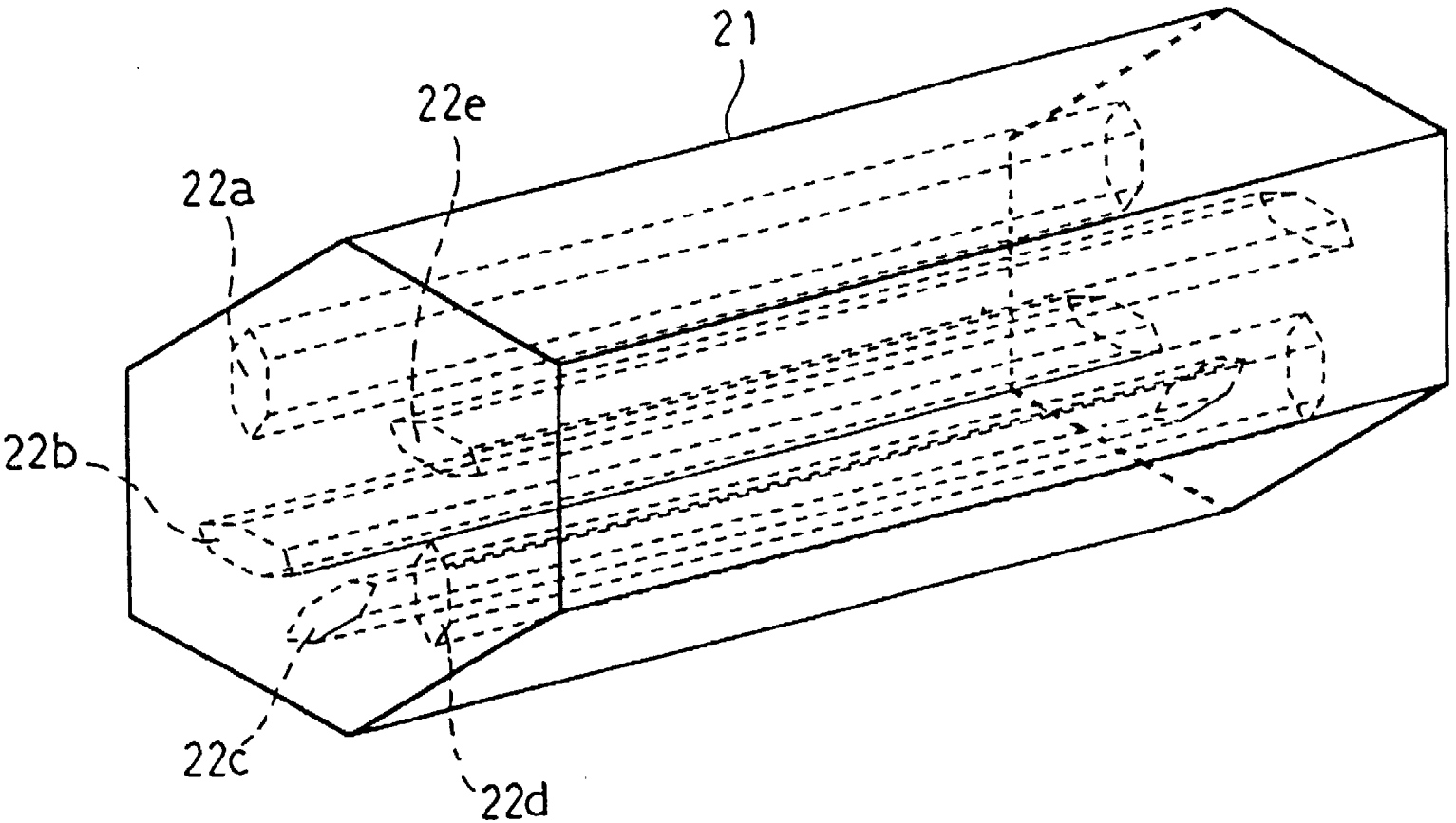
FIG. 6 is a schematic perspective view showing the external appearance of the same plating barrel apparatus.

The nickel layers 14a, 14b and solder layers 15a, 15b of the chip-type composite electronic component according to the illustrated embodiment may be conveniently formed by using such a plating barrel apparatus as is schematically illustrated in FIGS. 5 and 6. The plating barrel apparatus includes a plating barrel body 21 in which five agitating plates 22a–22e are arranged. Each of the agitating plates 22a–22e is inclined relative to a straight line which is perpendicular to another straight line passing through the rotational center of the plating barrel body 21 and the center of the respective agitating plates 22a–22e.

More specifically, as shown in FIG. 5, the agitating plate 22a for example is inclined by an angle θ relative to a straight line (d) which is perpendicular to another straight line (c) passing through the rotational center (a) of the plating barrel body 21 and the center (b) of the agitating plate 22a. This inclination angle θ also applies to the other agitating plates 22b–22e. It should be noted that the barrel body 21 is formed with a multiplicity of pores (not shown) for allowing ingress of a plating liquid into the barrel body For plating, a multiplicity of chip-type composite electronic components are loaded into the plating barrel body 21 together with steel shots and ceramic balls, and the barrel body 21 is immersed in a plating liquid (plating liquid for nickel plating or solder plating). In this state, when the barrel body 21 is rotated in the direction of an arrow A, the agitating plates 22a–22e lift up the chip-type composite electronic components gravitationally collected in a lower portion of the barrel body 21 together with the steel shots and the ceramic balls, thereby sufficiently agitating to prevent layer-like separation among the electronic components, the steel shots and the ceramic balls.

As a result, the multiplicity of chip-type composite electronic components within the plating barrel body 21 will rarely suffer variations, from component to component, in the rate or speed of forming nickel layers 14a, 14b or solder layers 15a, 15b. Thus, even if the respective thickness of nickel layers 14a, 14b and solder layers 15a, 15b is adjusted to have a predetermined value with respect to electronic components undergoing slower layer formation, the nickel layers 14a, 14b and solder layers 15a, 15b for other electronic components undergoing faster layer formation can be prevented from growing to have an excessively large thickness.

Viewed with respect to each of the chip-type composite electronic components, the individual electrodes 3a–3h connected to the resistor elements 4a–4e having a large electrical resistance will suffer difficulty in forming nickel layers 14b or solder layers 15b. However, due to agitation by the agitating plates 22a–22e inside the barrel body 21, even if the respective thickness of nickel layers 14b and solder layers 15b for each of the individual electrode is adjusted to have a predetermined value, the nickel layers 14a and solder layers 15a for the common electrode 2 having an extremely low resistance can be prevented from growing to have an excessively large thickness.

For comparison, use was made of the plating barrel apparatus shown in FIGS. 5 and 6 as well as another plating barrel apparatus having no agitating plate for forming plated nickel layers 14a, 14b and solder layers 15a, 15b with respect to a multiplicity of chip-type composite electronic components. Then, the average thickness of the nickel layers 14a for the common electrode 2 was divided by the average thickness of the nickel layers 14b for the individual electrodes 3a–3h to give a ratio. Similarly, the average thickness of the solder layers 15a for the common electrode 2 was divided by the average thickness of the solder layers 15b for the individual electrodes 3a–3h to give a ratio. Such comparison was performed with respect to different resistance values of resistor elements 4a–4e which included 10K Ω, 47K Ω and 100K Ω. The results are shown in FIG. 7.

As understood from FIG. 7, with regard to the solder layers, when the plating barrel apparatus incorporating the agitating plates 22a–22e is used, a ratio of 2.33 is obtained in case the resistors R1–R8 (FIG. 2) have a resistance of 10K Ω, 2.37 for 47K Ω, and 2.68 for 100K Ω. With respect to the nickel layers, a ratio of 2.35 is obtained in case the resistors R1–R8 have a resistance of 10K Ω, 3.20 for 47K Ω, and 2.93 for 100K Ω. By contrast, when the plating barrel apparatus incorporating no agitating plate is used, the thickness of the solder layer 15a at the common electrode 2 tends to be unduly larger than the thickness of the solder layer 15b at each of the individual electrodes 3a–3h connected to the resistors R1–R8 if the resistance of the resistors R1–R8 is no less than 47K Ω. This also applies to the nickel layers 14a, 14b.

In this way, by using the plating barrel apparatus incorporating the agitating plates 22a–22e, it is possible to obtain, with a high yield, chip-type composite electronic components wherein the resistors R1–R8 have a resistance of no less than 47K Ω and wherein the thickness of the solder layer 15a for the common electrode 2 is no more than 2.9 times as great as the thickness of the solder layer 15b for each of the individual electrodes 3a–3h. It is also possible to obtain, with a high yield, chip-type composite electronic components wherein the resistors R1–R8 have a resistance of no less than 47K Ω and wherein the thickness of the nickel layer 14a for the common electrode 2 is no more than 3.2 times as great as the thickness of the nickel layer 14b for each of the individual electrodes 3a–3h.

In the above-described embodiment, the elements interposed between the respective individual electrode 3a–3h and the common electrode 2 are the film-like resistor elements R1–R8 constituting the resistors R1–R8 which are equal in resistance. However, the respective resistors R1–R8 may not be mutually equal in resistance as long as the resistance is no less than 47K Ω at the lowest.

Further, the elements interposed between the respective individual electrode 3a–3h and the common electrode 2 may be capacitors which exhibit a direct current resistance of no less than 47K Ω when sufficiently charged, or diodes having a reverse direct current resistance of no less 47K Ω. In the case of capacitors or diodes, though they do not always exhibit a direct current resistance of no less than 47K Ω, they may exhibit a high resistance of no less than 47K Ω depending on their charging state or polarity, so that there will be a difference in plated layer thickness between the common electrode 2 and each of the individual electrodes 3a–3h. Such a difference can be reduced by using the plating barrel apparatus with the agitating plates 22a–22e for plating the nickel layers 14a, 14b and solder layers 15a, 15b.

We claim:

1. A chip-type composite electronic component comprising:

an insulating substrate;

a common electrode formed on the substrate;

a plurality of individual electrodes formed on the substrate to be spaced from the common electrode, and a plurality of electronic elements each interposed between each of the individual electrodes and the common electrode;

wherein each of the common electrode and individual electrodes has a plated solder layer as an outermost layer;

characterized that each of the electronic elements has a direct current resistance of no less than 47K Ω, the solder layer of the common electrode having a layer thickness which is no more than 2.9 times as great as that of the solder layer of the individual electrodes.

2. The chip-type composite electronic according to claim 1, wherein the electronic elements are resistors.

3. The chip-type composite electronic according to claim 2, wherein the resistors are equal to each other in resistance.

4. The chip-type composite electronic according to claim 1, wherein each of the electronic elements is a capacitor which has a direct current resistance of no less than 47K Ω when sufficiently charged.

5. The chip-type composite electronic according to claim 1, wherein each of the electronic elements is a diode which has a reverse direct current resistance of no less than 47K Ω.

6. The chip-type composite electronic according to claim 1, wherein each of the common electrode and individual electrodes has a plated nickel layer, the nickel layer of the common electrode having a layer thickness which is no more than 3.2 times as great as that of the nickel layer of the individual electrodes.

7. A chip-type composite electronic component comprising:

an insulating substrate;

a common electrode formed on the substrate;

a plurality of individual electrodes formed on the substrate to be spaced from the common electrode, and a plurality of electronic elements each interposed between each of the individual electrodes and the common electrode;

wherein each of the common electrode and individual electrodes has a plated nickel layer;

characterized that each of the electronic elements has a direct current resistance of no less than 47K Ω, the nickel layer of the common electrode having a layer thickness which is no more than 3.2 times as great as that of the nickel layer of the individual electrodes.

* * * * *